US007988439B2

(12) United States Patent
Kim

(10) Patent No.: US 7,988,439 B2
(45) Date of Patent: Aug. 2, 2011

(54) NOZZLE BLOCK FOR ELECTROSPINNING

(75) Inventor: Hak-Yong Kim, Jeonju-si (KR)

(73) Assignee: Industrial Cooperation Foundation Chonbuk National University, Jeonju-si (KR)

( * ) Notice: Subject to any disclaimer, the term of this patent is extended or adjusted under 35 U.S.C. 154(b) by 826 days.

(21) Appl. No.: 11/917,331

(22) PCT Filed: Mar. 16, 2006

(86) PCT No.: PCT/KR2006/000960

§ 371 (c)(1),
(2), (4) Date: Dec. 12, 2007

(87) PCT Pub. No.: WO2007/061160

PCT Pub. Date: May 31, 2007

(65) Prior Publication Data

US 2009/0297651 A1 Dec. 3, 2009

(30) Foreign Application Priority Data

Nov. 24, 2005 (KR) ..... 10-2005-0112742

(51) Int. Cl.
*D01D 4/06* (2006.01)

(52) U.S. Cl. ..... 425/131.5; 425/174.8 E; 425/192 S; 425/463

(58) Field of Classification Search ..... 425/131.5, 425/174.8 E, 192 S, 463
See application file for complete search history.

(56) References Cited

U.S. PATENT DOCUMENTS

| | | | | |
|---|---|---|---|---|
| 4,044,404 | A | 8/1977 | Martin et al. | |
| 5,102,590 | A | 4/1992 | Takahara et al. | |
| 5,234,650 | A * | 8/1993 | Hagen et al. | 264/176.1 |
| 5,720,838 | A * | 2/1998 | Nakata | 156/167 |
| 5,891,482 | A * | 4/1999 | Choi | 425/72.2 |
| 6,110,590 | A | 8/2000 | Zarkoob et al. | |
| 6,241,503 | B1 * | 6/2001 | Wright et al. | 425/131.5 |
| 6,361,736 | B1 * | 3/2002 | Dugan et al. | 264/172.15 |
| 2002/0117770 | A1 | 8/2002 | Haynes et al. | |

FOREIGN PATENT DOCUMENTS

WO WO-03/004735 A1 1/2003

* cited by examiner

*Primary Examiner* — Yogendra N Gupta
*Assistant Examiner* — Joseph Leyson
(74) *Attorney, Agent, or Firm* — Birch, Stewart, Kolasch & Birch, LLP

(57) ABSTRACT

Disclosed is a nozzle block for electrospinning which is able to simultaneously electrically spin two or more different types of polymer spinning dopes, wherein a single-layer distribution plate for dividing a planar space within the nozzle block into two or more segments is installed within the nozzle block. The apparatus is simple because a single-layer distribution plate is installed instead of a conventional multi layer distribution plate. A hybrid nano fiber laminate can be prepared without any additional laminating procedure because two or more different polymer spinning dopes can be simultaneously electrically spun through different nozzles arranged within the same nozzle block. It is possible to prepare a hybrid nano fiber nonwoven fabric or filaments or the like composed of two or more types of nano fibers different in thermal properties or physical properties because their fiber diameter or polymer type are different from each other.

6 Claims, 5 Drawing Sheets

NOZZLE BLOCK FOR ELECTROSPINNING

TECHNICAL FIELD

The present invention relates to a nozzle block for electrospinning which is able to simultaneously electrically spin two or more different polymer spinning dopes separately, and more particularly, to a nozzle bock for electrospinning, which is simple in structure and easy to manufacture by having a single-layer distribution plate for supplying two or more polymer spinning dopes separately to different nozzles arranged within the same nozzle block.

BACKGROUND ART

A conventional electrospinning apparatus and a process for preparing a non-woven fabric using the same have been disclosed in U.S. Pat. No. 4,044,404.

The conventional electrospinning apparatus includes; a spinning dope main tank for storing a spinning dope; a metering pump for quantitatively supplying the spinning dope; a plurality of nozzles for discharging the spinning dope; a collector positioned at the lower end of the nozzles, for collecting the spun fibers; a voltage generator for generating a voltage; and a plurality of instruments for transmitting the voltage to the nozzles and the collector.

The conventional process for preparing the non-woven fabric using the electronic spinning apparatus will now be described in detail. The spinning dope of the spinning dope main tank is consecutively quantitatively provided to the plurality of nozzles supplied with a high voltage through the metering pump.

Continuously, the spinning dope supplied to the nozzles is spun and collected on the collector supplied with the high voltage through the nozzles, thereby forming a single fiber (nano fiber) web.

However, the conventional electrospinning apparatus alone is unable to electrically spin two or more different polymer spinning dopes separately, thus nano fibers made from two or more polymer spinning dopes cannot be uniformly distributed in a nonwoven fabric or filaments.

Therefore, in order to distribute nano fibers made from two or more polymer spinning dopes in a nonwoven fabric or filaments by using the conventional electrospinning apparatus, two electrospinning apparatuses have to be installed side by side, and then different polymer spinning dopes have to be electrically spun in the respective apparatuses, which makes the apparatuses complex and the procedure difficult.

Meanwhile, a nozzle block with a distribution plate of two or more layers, that is, multi-layers, has been used in order to electrically spin two or more different polymer spinning dopes separately through different nozzles arranged in the same nozzle block.

The conventional nozzle block has been problematic in that the apparatus and the procedure is complex because it has a distribution plate of multi-layers installed therein.

DETAILED DESCRIPTION OF THE INVENTION

Technical Problems

For the solution of the conventional problem, the present invention provides a nozzle block for electrospinning, which is simple in structure and easy to manufacture by having a single-layer distribution plate for supplying two or more polymer spinning dopes separately to nozzles arranged within the same nozzle block, and which is able to simultaneously electrically spin two or more types of polymer spinning dopes separately.

Technical Solutions

To solve the above-described problems, there is provided a nozzle block for electrospinning, which is able to simultaneously electrically spin two or more types of polymer spinning dopes through different nozzle arranged in the same nozzle block by having a single-layer distribution plate installed within the nozzle block, for dividing a planar space within the nozzle block into two or more segments.

Hereinafter, the present invention will be described in detail with reference to the accompanying drawings.

One or two or more single-layer distribution plates are installed in the nozzle block for electrospinning of the present invention, and the shapes of the distribution plate include a c-shape, a S-shape, an A-shape, a T-shape, a B-shape, a F-shape, etc.

FIG. 1 is a plane view of a nozzle block having one U-shaped distribution plate installed thereon. FIG. 3 is a plane view of a nozzle block having four U-shaped distribution plates installed thereon. FIG. 4 is a plane view of one S-shaped distribution plate installed thereon. FIG. 5 is a plane view of a nozzle block having one A-shaped distribution plate.

Besides, FIG. 6 is a plane view of a nozzle block having a U-shaped distribution plate for dividing a planar space within the nozzle block into three so that three different types of polymer spinning dopes can be simultaneously electrically spun.

FIG. 2 and FIG. 7 are side views of FIG. 1 and FIG. 6, respectively.

In FIGS. 1 and 2, a first polymer spinning dope stored in a first polymer spinning dope tank 3 is supplied into a nozzle block 1 through its supply line 3*a* and a metering pump. Meanwhile, a second polymer-spinning dope stored in a second polymer spinning dope tank 4 is supplied into the nozzle block 1 through its supply line 4*a* and the metering pump.

The first polymer spinning dope and second polymer spinning dope thus-supplied into the nozzle block l separately are supplied to nozzle A and nozzle B, respectively, arranged within the same nozzle block by a U-shaped distribution plate 2*b* installed within the nozzle block, and then electrically spun.

Specifically, the first polymer spinning dope is supplied to nozzle A and electrically spun, and the second polymer spinning dope is supplied to nozzle B and electrically spun.

In FIGS. 6 and 7, a first polymer spinning dope stored in a first polymer spinning dope tank 3 is supplied into a nozzle block 1 through its supply line 3*a* and a metering pump.

Meanwhile, a second polymer spinning dope stored in a second polymer spinning dope tank 4 is supplied into the nozzle block 1 through its supply line 4*a* and the metering pump.

Meanwhile, a third polymer spinning dope stored in a third polymer spinning dope tank 5 is supplied into the nozzle block 1 through its supply line 5*a* and the metering pump.

The three types of polymer spinning dopes thus-supplied into the same nozzle block 1 separately are supplied to nozzle A, nozzle B, and nozzle C, respectively, by two U-shaped distribution plates 2*b* installed in the nozzle block 1, and then electrically spun.

Specifically, the first polymer spinning dope is supplied to nozzle A and electrically spun, the second polymer spinning dope is supplied to nozzle B and electrically spun, and the third polymer spinning dope is supplied to nozzle C and electrically spun.

The thus electrospun nano fibers are collected on a collector, thereby forming a nano fiber web.

The nano fiber web is dried, pressed, and embossed to prepare a nano fiber nonwoven fabric.

In case of preparing a nano fiber using a thermosetting resin, a nonwoven fabric can be prepared by curing treatment.

Because the nano fiber nonwoven fabric prepared in the present invention includes two or more different types of nano fibers, the laminating procedure can be performed in one line.

FIG. 8 is a plane view of a nozzle block according to the present invention where two types of nozzles A and B are arranged in a circumferential direction, for electrically spinning different polymer spinning dopes by using a U-shaped distribution plate.

When it is desired to use the nozzles of such a type, a collector is bilaterally moved so that nano fibers can be uniformly collected in a. width direction. When it is desired to use a cylindrical collector, the collector can be easily prepared with a desired width by making it to be traversed to the left and right white rotating.

In case of arranging nozzles in a circular form, it is advantageous in many aspects because a very large quantity of nozzles can be arranged, which is very economical, and it does not matter even if the installation space is narrow.

Within the nozzle block for electrospinning of the present invention, preferably 100 or more nozzles, rather than two or more nozzles, are arranged in a circumferential direction, horizontal direction, longitudinal direction, diagonal direction, and so on.

Additionally, within the nozzle block, nozzles A and B for electrically spinning different polymer spinning dopes are arranged in repeating units, for example, of 1:1, 2:1, 1:2, 1:3, 3:1, etc.

Different polymer spinning dopes are supplied to the nozzles in repeating units by the distribution plate.

Different polymer spinning dope supply lines 3*a*, 4*a*, 5*a* are connected to the segments formed by division by the distribution plate, respectively, thereby supplying one type of polymer spinning dope to each of the segments.

Meanwhile, a residual polymer spinning dope recovery plate of the same shape as the above-explained distribution plate is installed on top of the nozzle block in order to recover the spinning dope oversupplied and remaining on the nozzle block.

The polymer spinning dope is one type of resin selected from the group consisting of polyester resins, acryl resins, phenol resins, epoxy resins, melamine resins, nylon resins, poly(glycolide/L-lactide) copolymers, poly(L-lactide) resins, polyvinyl alcohol resins, polyvinyl chloride resins, mixtures thereof, and copolymers thereof.

The spinning dope may be a sol-gel solution containing inorganic material, or a solution containing carbon nanotube.

By means of the nozzle block of the present invention, two or more types of polymer spinning dopes having a different type of polymer may be electrically spun, or two or more types of polymer spinning dopes having the same type of polymer but a different concentration, electric conductivity, surface tension or the like may be electrically spun.

In the electrospinning method, any angle formed between the nozzles and the collector is applicable. That is, any angle therebetween is all applicable to a downward electrospinning in which nozzles are positioned in the upper part and a collector is positioned in the lower part, an upward electrospinning in which nozzles are positioned in the lower part and a collector is positioned in the upper part, an electrospinning system in which nozzles are positioned at the outside and a rotating collector is installed at the inside, an electrospinning method in which nozzles and a collector are formed at a predetermined angle.

Advantageous Effects

The present invention is able to prepare a nano fiber laminate without any additional laminating procedure because two or more different polymer spinning dopes can be electrically spun separately through different nozzles arranged in the same nozzle block, and easily prepare a hybrid nano fiber nonwoven fabric or filaments or the like.

Additionally, the nozzle block for electrospinning of the present invention has a simple structure and is easy to manufacture because a single-layer distribution plate is installed.

Figure 1:
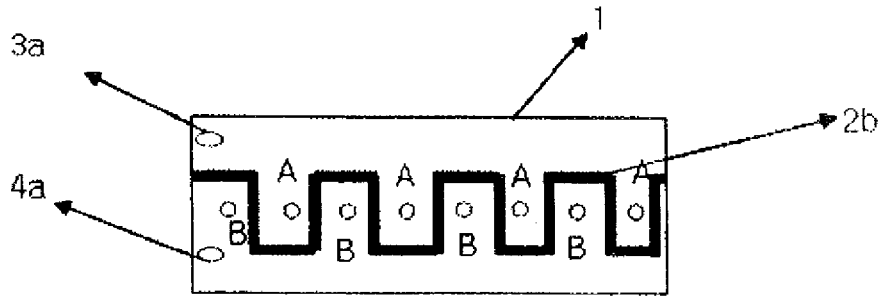
FIG. 1 is a plane view of a nozzle block according to the present invention having one U-shaped distribution plate installed thereon.
Figure 2:
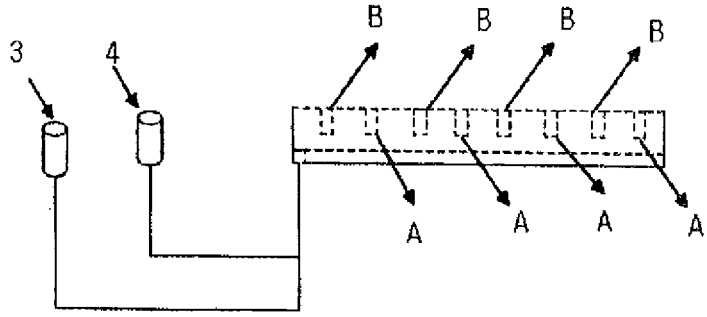
FIG. 2 is a schematic side view of the nozzle block according to the present invention having one U-shaped distribution plate installed thereon.

Explanation of Reference Numerals for the Major Parts in the Drawings

1: nozzle block 2*a*: S-shaped distribution plate
2*b*: U-shaped distribution plate 2*c*: A-shaped distribution plate
3: first polymer spinning dope tank
3*a*: first polymer spinning dope supply line
4: second polymer spinning dope tank
4*a*: second polymer spinning dope supply line

5: third polymer spinning dope tank

5*a*: third polymer spinning dope supply line

A: nozzle for electrically spinning first polymer spinning dope

B: nozzle for electrically spinning second polymer spinning dope

C: nozzle for electrically spinning third polymer spinning dope

W: tensile stress-strain curve of nano fiber nonwoven fabric prepared by Example 1

X: tensile stress-strain curve of nano fiber nonwoven fabric prepared by Example 2

Y: tensile stress-strain curve of nano fiber nonwoven fabric prepared by Example 3

Z: tensile stress-strain curve of nano fiber nonwoven fabric prepared by Example 4

BEST MODE FOR CARRYING OUT THE INVENTION

Hereinafter, the present invention will be described concretely with reference to examples

EXAMPLE 1

A nylon spinning dope (hereinafter referred to as a "first spinning dope") having a polymer concentration of 20% by weight was prepared by dissolving polyamide 6 (manufactured by Kolon Industries Inc.), which has a relative viscosity of 2.8, in a mixed solvent of formic acid/acetic acid (volume ratio: 80:20).

The prepared first spinning dope had a viscosity of 12,000 centipose, and an electric conductivity of 0.25 S/m.

Next, a polyvinyl alcohol spinning dope (hereinafter referred to as a "second spinning dope") having a polymer concentration of 12% by weight was prepared by dissolving polyvinyl alcohol (manufactured by Dongyang Chemical) having a weight average molecular weight of 80,000 in a mixed solvent of formic acid/acetic acid (volume ratio: 57/43)

The prepared second spinning dope had a solution viscosity of 1,450 centipoise.

Figure 3:
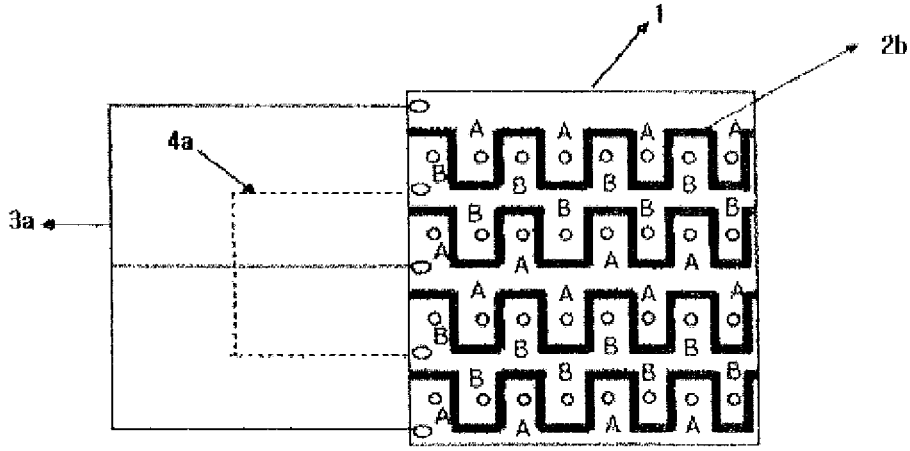
FIG. 3 is a plane view of a nozzle block according to the present invention having four U-shaped distribution plates installed thereon.
Figure 4:
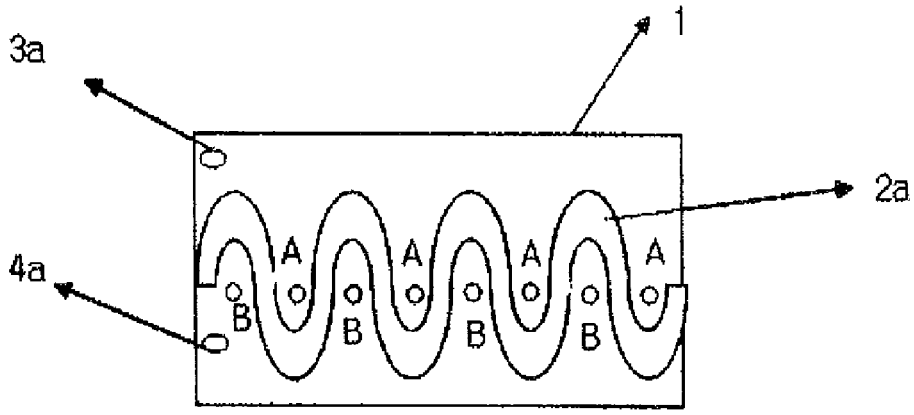
FIG. 4 is a plane view of a nozzle block according to the present invention having one S-shaped distribution plate installed thereon.
Figure 5:
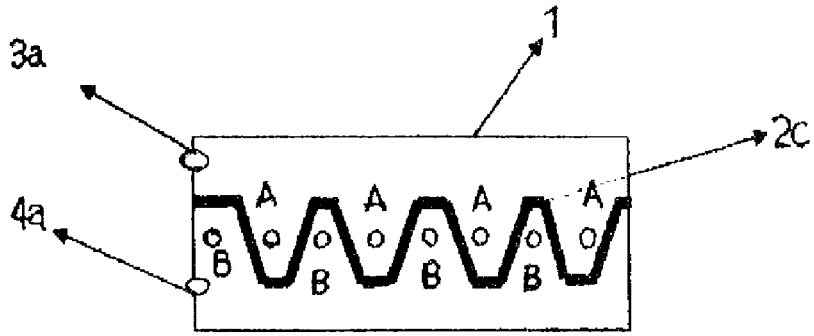
FIG. 5 is a plane view of a nozzle block according to the present invention having one A-shaped distribution plate.
Figure 6:
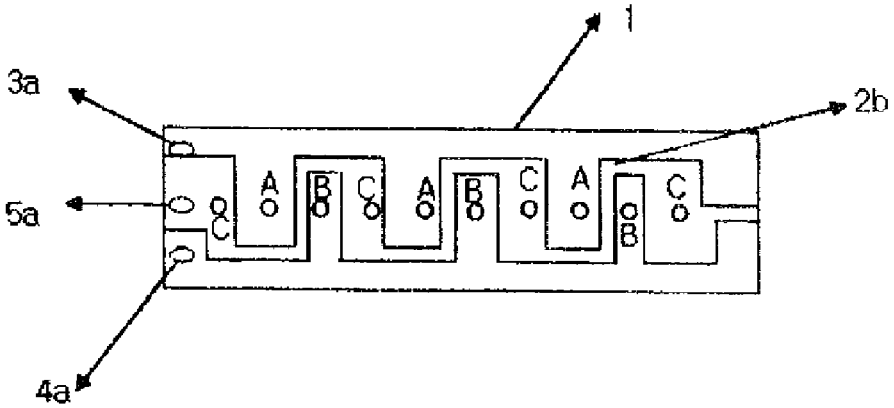
FIG. 6 is a plane view of a nozzle block according to the present invention having a U-shaped distribution plate for dividing a planar space within the nozzle block into three so that three different types of polymer spinning dopes can be simultaneously electrically spun.
Figure 7:
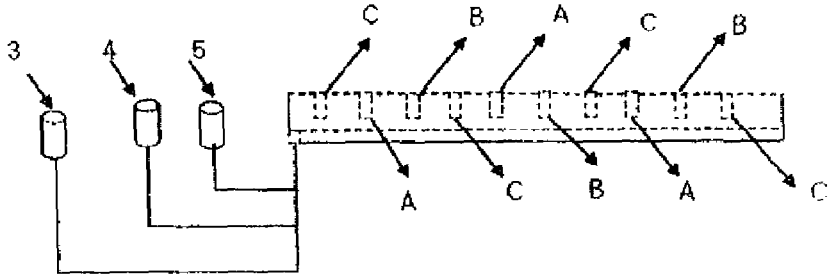
FIG. 7 is a schematic side view of FIG. 6.
Figure 8:
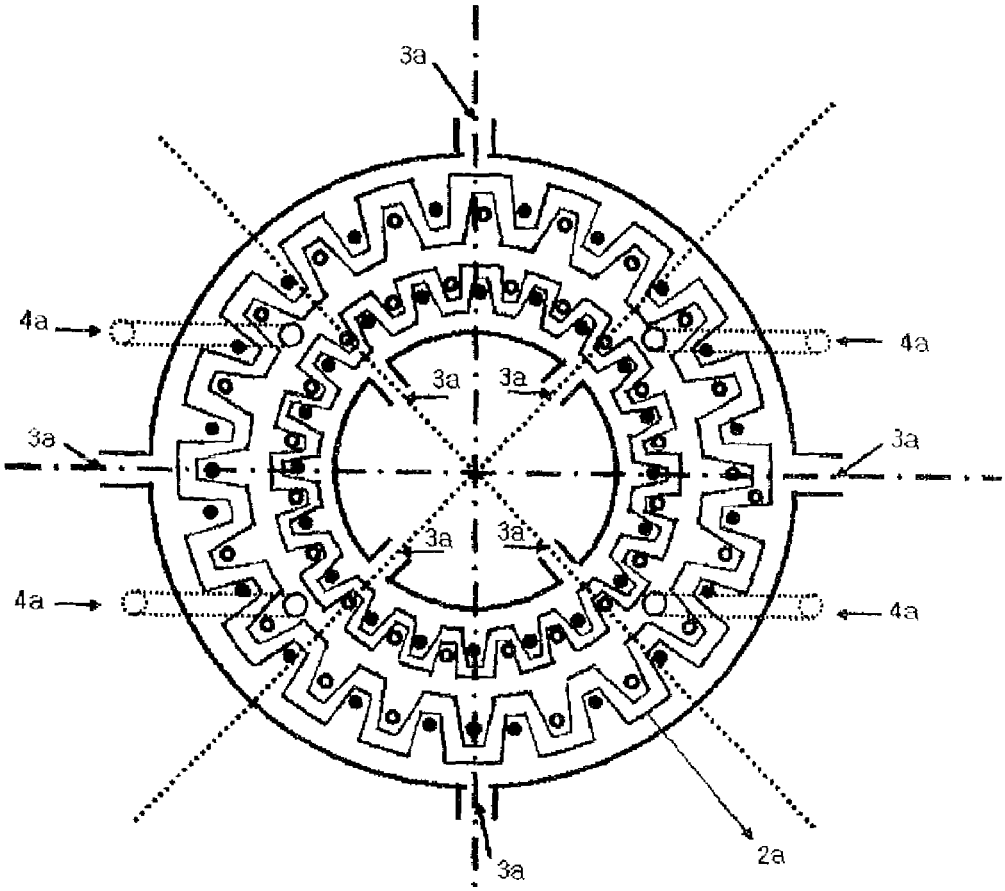
FIG. 8 is a plane view of a nozzle block according to the present invention where two types of nozzles are arranged in a circumferential direction, for electrically spinning different polymer spinning dopes by using a U-shaped distribution plate.

Next, by using the nozzle block having a single-layer S-shaped distribution plate of FIG. 3, the prepared first spinning dope was electrically spun through nozzle A, and the second spinning dope was electrically spun through nozzle B, thereby preparing a nano fiber nonwoven fabric.

At this time, nozzle A and nozzle B are arranged in an alternating manner within the nozzle block. With respect to the entire nozzles, 200 nozzles are arranged horizontally, and 50 nozzles are arranged longitudinally. Thus, the total number of the nozzles is 10,000, and the number of nozzle A and of nozzle B is 5,000, respectively.

The diameter of nozzle A and nozzle B is 0.9 mm, respectively.

At the time of electrospinning, the gap between the nozzles and a collector was set to 70 cm, a drum rotating at a velocity of 480 m/min was used as a collector, and the nozzles and the collector had a voltage of 30 kv applied thereto.

Figure 9:
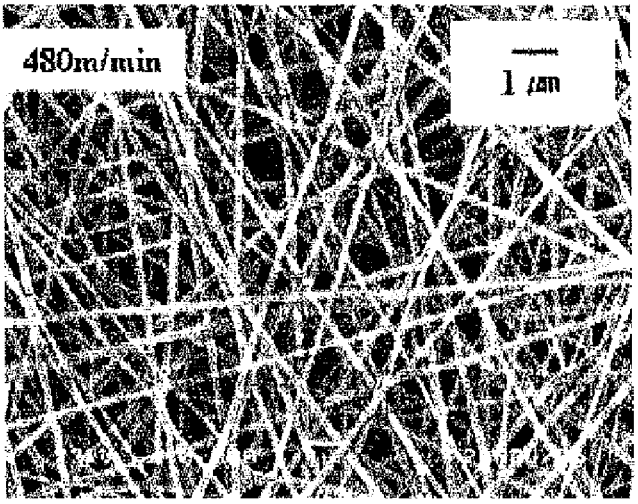
FIG. 9 is an electron micrograph of a nano fiber nonwoven fabric prepared by Example 1.
Figure 13:
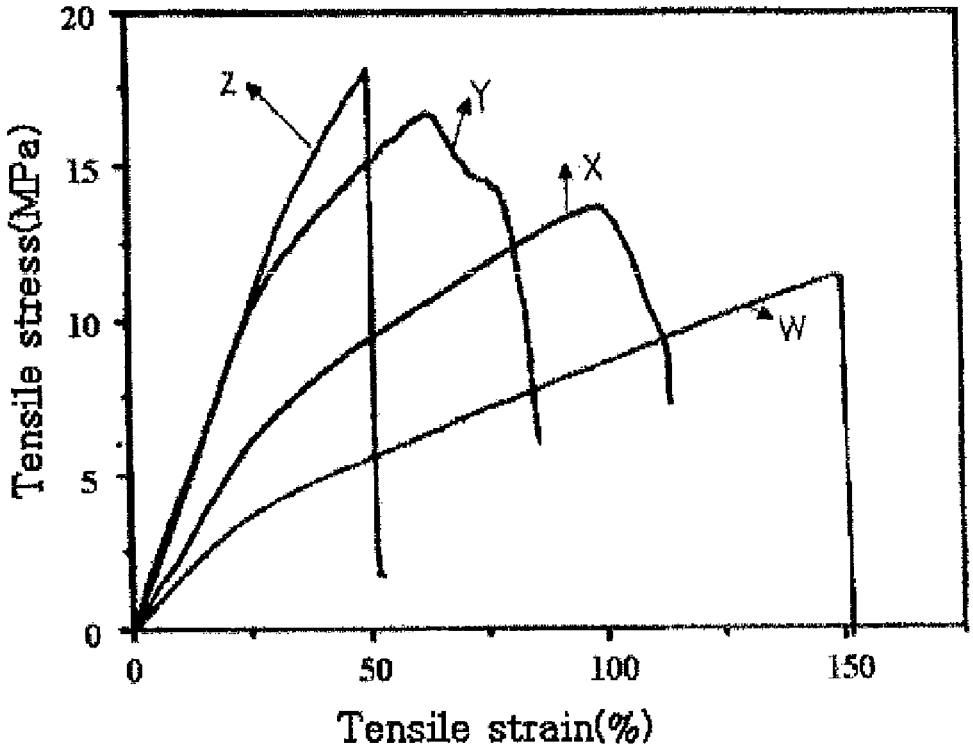
FIG. 13 is a tensile stress-strain curve of the nano fibers fabric prepared by Examples 1 to 4.

An electro micrograph of the thus-prepared nano fiber nonwoven fabric is FIG. 9, and a tensile stress-strain curve of the prepared nano fiber nonwoven fabric is as shown in W of FIG. 13.

EXAMPLE 2

A nano fiber nonwoven fabric was prepared in the same mariner as in Example 1 except that the rotation velocity of the collector is changed to 900 m/min.

Figure 10:
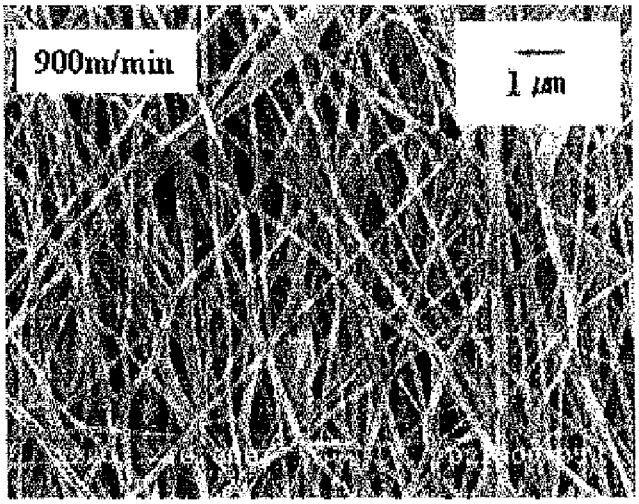
FIG. 10 is an electron micrograph of a nano fiber nonwoven fabric prepared by Example 2.
Figure 11:
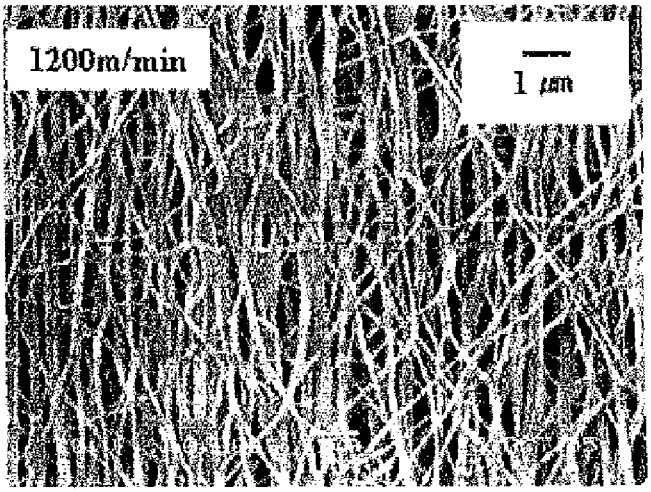
FIG. 11 is an electron micrograph of a nano fiber nonwoven fabric prepared by Example 3.

An electro micrograph of the thus-prepared nano fiber nonwoven fabric is FIG. 10, and a tensile stress-strain curve of the prepared nano fiber nonwoven fabric is as shown in X of FIG. 13.

EXAMPLE 3

A nano fiber nonwoven fabric was prepared in the same manner as in Example 1 except that the rotation velocity of the collector is changed to 1,200 m/min.

An electro micrograph of the thus-prepared nano fiber nonwoven fabric is FIG. 1, and a tensile stress-strain curve of the prepared nano fiber nonwoven fabric is as shown in Y of FIG. 13.

EXAMPLE 4

A nano fiber nonwoven fabric was prepared in the same manner as in Example 1 except that the rotation velocity of the collector is changed to 1,800 m/min.

Figure 12:
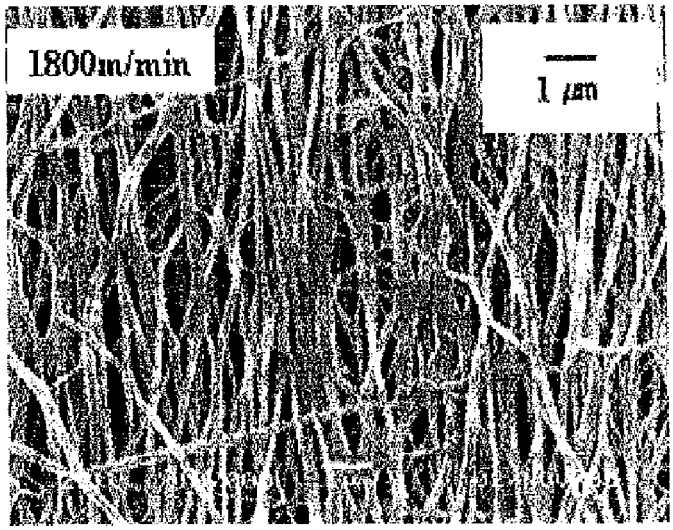
FIG. 12 is an electron micrograph of a nano fiber nonwowen fabric prepared by Example 4.

An electro micrograph of the thus-prepared nano fiber nonwoven fabric is FIG. 12, and a tensile stress-strain curve of the prepared nano fiber nonwoven fabric is as shown in Z of FIG. 13.

INDUSTRIAL APPLICABILITY

The present invention is able to prepare a nano fiber laminate without any additional laminating procedure, and easily prepare a hybrid nano fiber, filaments, etc. with various physical properties.

What is claimed is:

1. An apparatus including a nozzle block for electrospinning, which is able to simultaneously electrically spin two or more types of polymer spinning dopes through different nozzle arranged in the same nozzle block by having a single-layer distribution plate installed within the nozzle block, for dividing a planar space within the nozzle block into two or more segments, and a residual polymer spinning dope recovery plate of the same shape as the distribution plate installed on top of the nozzle block.

2. The apparatus of claim 1, wherein one or two or more single-layer distribution plates are installed in the nozzle block.

3. The apparatus of claim 1, wherein the shape of the distribution plate is one selected from the group consisting of a U-shape, an S-shape, an A-shape, a T-shape, a B-shape, and an F-shape.

4. The apparatus of claim 1, wherein two or more nozzles are arranged in either a circumferential, horizontal, longitudinal, or diagonal direction.

5. The apparatus of claim 4, wherein nozzles for electrically spinning different polymer spinning dopes are arranged in repeating units within the nozzle block.

6. The apparatus of claim 1, wherein different polymer spinning dope supply lines are connected to the segments formed by division by the distribution plate, respectively.

* * * * *